US008926408B2

(12) United States Patent
Hasegawa

(10) Patent No.: US 8,926,408 B2
(45) Date of Patent: Jan. 6, 2015

(54) BLADE SHARPENER

(75) Inventor: Tom Hiroshi Hasegawa, Gardena, CA (US)

(73) Assignees: Tom Hiroshi Hasegawa, Gardena, CA (US); Kabushiki Kaisha Suehiro, Niigata-Ken (JP)

( * ) Notice: Subject to any disclaimer, the term of this patent is extended or adjusted under 35 U.S.C. 154(b) by 140 days.

(21) Appl. No.: 13/594,650

(22) Filed: Aug. 24, 2012

(65) Prior Publication Data

US 2013/0295824 A1 Nov. 7, 2013

Related U.S. Application Data

(63) Continuation-in-part of application No. 13/463,642, filed on May 3, 2012, now abandoned.

(51) Int. Cl.
*B25B 7/00* (2006.01)

(52) U.S. Cl.
USPC ..... 451/194; 451/192; 451/262; 451/263

(58) Field of Classification Search
USPC ..... 451/192, 194, 262, 263
See application file for complete search history.

(56) References Cited

U.S. PATENT DOCUMENTS

| | | | | |
|---|---|---|---|---|
| 7,722,443 | B2 * | 5/2010 | Levsen | 451/262 |
| 8,585,462 | B2 * | 11/2013 | Jensen et al. | 451/41 |

FOREIGN PATENT DOCUMENTS

| | | |
|---|---|---|
| JP | S62-181860 | 8/1987 |
| JP | 3007312 U | 2/1995 |
| JP | 3010973 U | 5/1995 |
| JP | 3128435 U | 1/2007 |

* cited by examiner

*Primary Examiner* — Lee D Wilson
*Assistant Examiner* — Shantese McDonald
(74) *Attorney, Agent, or Firm* — DLA Piper LLP (US)

(57) ABSTRACT

A blade sharpener including a main frame casing having a grip and a grinding chamber and a grinder assembly detachably installed in the grinding chamber in which the grinder assembly is formed by a pair of shaft supports facing each other, a supporting window provided in each of the shaft supports, a rotary shaft supported at both end portions thereof by the vertical shaft supports, an abrasive wheel provided on the rotary shaft at substantially its axial center, and a pair of lateral coil springs each provided on either side of the abrasive wheel. The rotary shaft can be supported by a pair of longitudinal coil springs installed in the shaft supports.

15 Claims, 11 Drawing Sheets

BLADE SHARPENER

BACKGROUND OF THE INVENTION

1. Field of the Invention

The present invention relates to a blade sharpener that sharpens blades such as kitchen knives and table knives with an abrasive wheel and more particularly to a manual blade sharpener having an abrasive wheel therein.

2. Background Art

Japanese Patent Application Laid-Open (Kokai) No. S62-181860 discloses a table knife sharpener that is comprised of a main frame casing, a adhesive wheel rotatably installed in this main frame casing and equipped with grinding surfaces that are of a truncated cone shape and forming an angle to each other, a guide part that guides the blade so that the blade being sharpened is pressed against both grinding surfaces, and a liquid vessel installed in the main frame casing so as to surround the bottom part of the abrasive wheel.

In this device, two sides of the blade of a knife is pressed against the two sides of the grindstone and the knife is moved back and forth at a bias relative to the axial direction of the abrasive wheel that has truncated conical grinding surfaces to sharpen both sides of the blade. This device has problems, however. During sharpening by the back and forth movements of the blade, frictional heat is generated, thus dulling the blade. Grinding dust from the blade would clog the pores of the abrasive wheel. Though the liquid vessel that contains liquid for cooling and cleaning the blade during the sharpening is provided, the problems of the frictional heat and clogging are not sufficiently solved. Furthermore, since the abrasive wheel is fixedly provided in the main frame casing, it is difficult to wash and clean the abrasive wheel.

Japanese Utility Model Registration No 3007312 discloses a blade sharpener that is to solve the problems above. This blade sharpener includes a main frame casing having a grip and a grinding chamber, a rotary shaft rotatably installed across the grinding chamber and arranged at a bias to the direction of the length of the main frame casing, an abrasive wheel that is installed in the center of the rotary shaft and has grinding surfaces which are truncated cones and form an angle to each other, a guide part that guides the blade so that the blade being sharpened is pressed against the two grinding surfaces, and a liquid vessel installed in the grinding chamber so that the liquid therein for cooling the abrasive wheel can surround the bottom part of the abrasive wheel. Also, Japanese Utility Model Registration No 3010973 discloses a sharpener for a single-blade knife in which an abrasive element is comprised of a pair of roller bodies having conical surfaces and one of the conical surfaces is a grinding surface and the other conical surface is a smooth, hard, non-grinding surface.

In these blade sharpeners described above, the side of a blade is, while being pressed against the grinding surface, sharpened by moving the blade back and forth along the guide part while it is being pressed against the conical surface of an abrasive wheel. Accordingly, sharpened conditions of blades can differ depending on how (in terms of pressing loads, pressing angles, etc.) the blade is pressed against the abrasive wheel. Pressing the blade too firmly will create defects in the cutting edge and can leave it to be able to cut less than before. In addition, blades with serrated cutting edges and fine ceramic blades cannot be sharpened very well even with use of a diamond abrasive wheel for the grinding surface.

Japanese Utility Model Registration No 3128435 discloses a blade sharpener that is to overcome the problems described above, and in this sharpener a rotary shaft that has an abrasive wheel is supported at both end thereof by a pair of vertically installed springs so that the blade can be evenly pressed against the abrasive wheel and evenly ground by the conical surfaces of the abrasive wheel.

SUMMARY OF THE INVENTION

Accordingly, the present invention is made with the above problems in mind, and it is an object of the present invention to provide a blade sharpener that is able to prevent variations in the force of pressing the cutting edge against conical surfaces of an abrasive wheel and can grind blades further evenly and smoothly compared to the existing blades sharpeners such as those described above.

The above object is accomplished by a unique structure of the present invention for a blade sharpener that includes:

- a main frame casing having a grinding chamber and a grip; and
- a sharpening assembly detachably installed in the grinding chamber and comprised of
  - a grinder frame formed by a support base and a pair of vertical shaft supports facing each other at both ends of the support base;
  - a vertically urging means provided in each of the vertical shaft supports;
  - a rotary shaft rotatably supported at both ends thereof by the vertically urging means and movable in the axial direction;
  - an abrasive element provided on the rotary shaft at substantially the axial center, and
  - a pair of horizontally urging means provided on both sides of the abrasive element.

Furthermore, the above object is accomplished by another unique structure of the present invention for a blade sharpener that comprises:

- a main frame casing having a grip and a grinding chamber; and
- a sharpening assembly which is detachably installed in the grinding chamber and comprised of:
  - an empty box shape grinder frame having a pair of vertical shaft supports facing each other;
  - a supporting window provided in each of the vertical shaft supports,
  - a vertically urging means provided in each of the vertical shaft supports;
  - a rotary shaft provided between the vertical shaft supports with both end thereof in the supporting windows of the vertical shaft supports and on the vertically urging means;
  - an abrasive element provided on the rotary shaft at substantially an axial center thereof; and
  - a pair of horizontally urging means each provided on either side of the abrasive element.

As seen from the above, in the structure of the blade sharpener of the present invention, since the abrasive element of the blade sharpener is constantly urged by the two horizontally urging means or lateral coil springs so that the abrasive element is at the mid point between the two vertical shaft supports or vertical shaft supports during the grinding process, the blade being ground receives lateral pressure (or pressing force) from both sides by the urging means and thus ca make good contact with the grinding surface of the abrasive element or abrasive wheel when the blade is moved back and forth with respect to the abrasive element and as a result is sharpened smoothly and efficiently.

Furthermore, since the blade sharpener of the present invention further includes vertically urging means or vertical coil springs, the blade that is receiving downwardly pressing force against the abrasive element by the user further receives upward pressing force caused by the vertically urging means or vertical coil springs that is in the direction opposite from the downward pressing force, in addition to the lateral pressure by the lateral urging means (or coil springs). Accordingly, the blade receives not only the lateral pressing force or pressure but also receives longitudinal pressure (or pressing force) from four directions (right and left and also downward and upward directions) and thus can make further good contact with the abrasive element when the blade is moved back and forth with respect to the abrasive element during grinding action, and the blade is thus sharpened further smoothly and efficiently.

In the present invention, since the sharpening assembly is detachable, it can be removed for cleaning or can be replaced with another or new one when the abrasive wheel is worn out.

DETAILED DESCRIPTION OF THE INVENTION

Preferred embodiments of a blade sharpener according to the present invention will be described in detail below with reference to the accompanying drawings.

Figure 1:
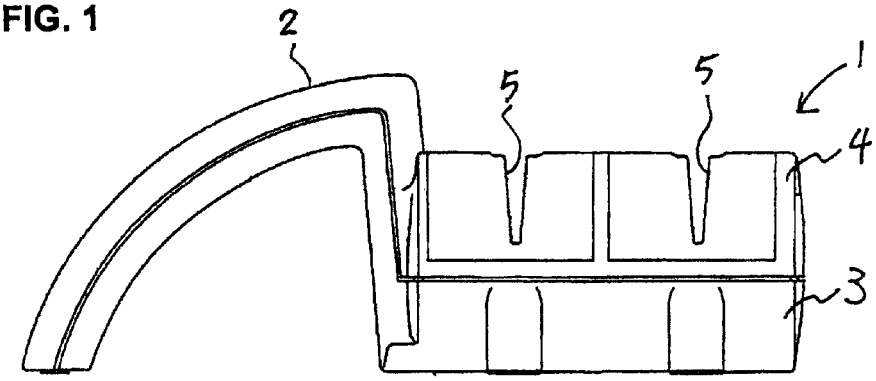
FIG. 1 shows a front view of a main frame casing of the blade sharpener according to the present invention.
Figure 2:
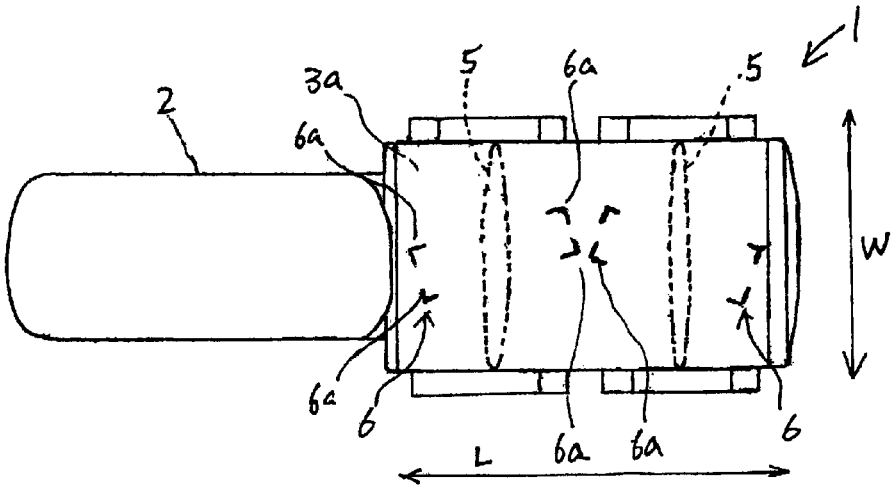
FIG. 2 is a top view thereof with the cover casing of the main frame casing removed.

FIGS. 1 and 2 illustrate one example of a main frame casing 1 of the blade sharpener according to the present invention. The main frame casing 1 is made of, for instance, synthetic resin and includes a grip 2 and a grinding chamber 3 which is connected to the end of the grip 2 and is substantially in a rectangular box shape having a size of, for instance 2.5 inches (W)×4 inches (L)×2.5 inches (H). The grinding chamber 3 is provided with a hinged open/close cover casing 4 covering the upper opening of the grinding chamber 3, and this removable cover casing 4 is formed with two blade guide slits 5 which extend in the width direction W of the grinding chamber 3 so as to open continuously to the above and to both sides of the cover casing 4.

Figure 3A:
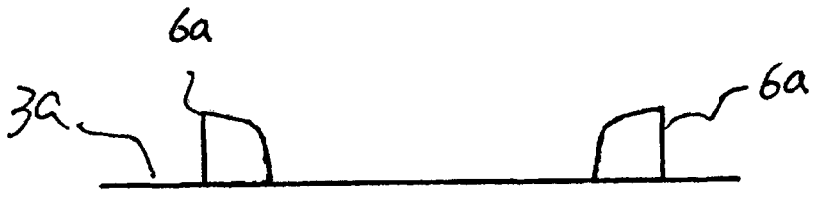
FIG. 3A is an enlarged side view of holding means and FIG. 3B is an enlarged top plan view thereof.
Figure 3B:
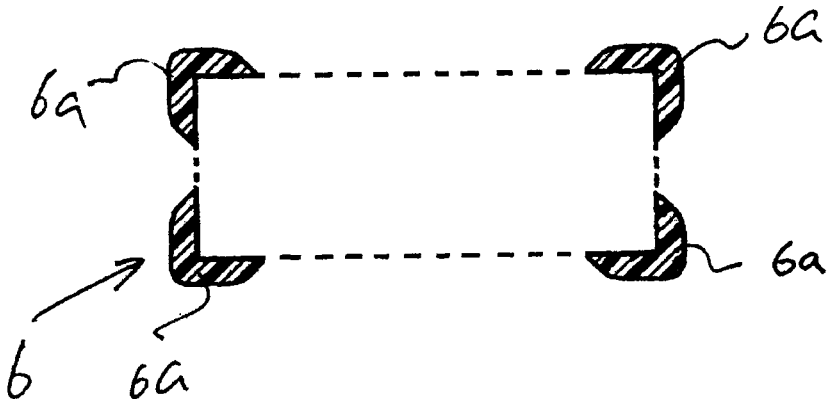

On the rectangular bottom 3*a* of the grinding chamber 3, one pair of (or two) holding means 6 (see FIG. 2) are provided. As seen from FIGS. 3A and 3B, each one of the holding means 6 is comprised of four projections 6*a* each of which is in a shape of L when viewed from above (or through the removable cover casing 4). Four projections 6*a* form a rectangular shape (when they are connected with dotted lines, see FIG. 3B) that is substantially the same as (or slightly smaller than) the bottom of each one of sharpening assemblies 10 (described below), so that the sharpening assembly 10 is held by the four projections 6*a* when the sharpening assembly 10 (or the bottom thereof) is pressed (by hand of a user of the sharpener) against the rectangular area defined by the four projections 6*a* from above so that the four corners of the sharpening assembly 10 are respectively in contact with the four projections 6*a* that are each in an L shape when viewed from above as described above. Since the holding means 6 (or the four projections 6*a*) and the sharpening assembly 10 are made of resins or plastics, and the sharpening assembly 10 is slightly larger than the area defined by the four projections 6*a*, the sharpening assembly 10 can be secured tightly in position by the holding means 6 and nonetheless can be separated therefrom when the sharpening assembly 10 is forcedly lifted or pulled upward (by hand). The sharpening assembly 10 is thus removed from the grinding chamber 3 for, for instance, cleaning of the sharpening assembly 10 (and the grinding chamber 3) and for replacement thereof.

Figure 4A:
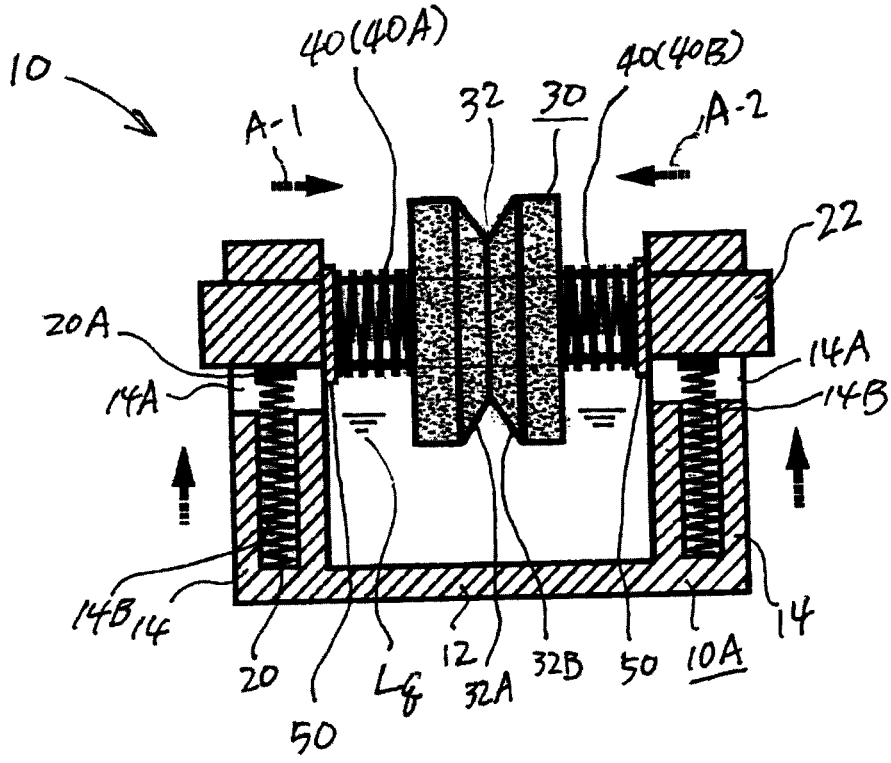
FIG. 4A is a vertically cross-sectional view of one type of sharpening assembly according to the present invention with a symmetric abrasive wheel employed.
Figure 4B:
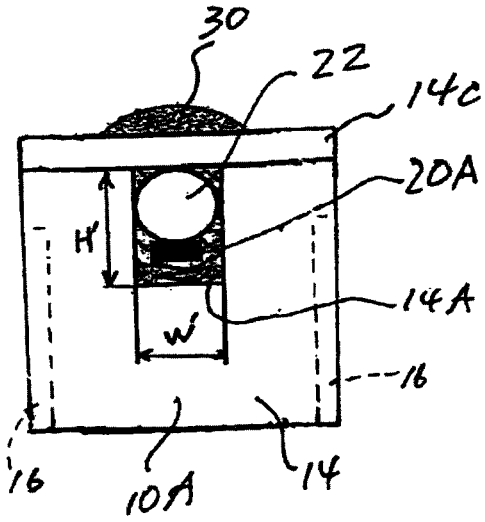
FIG. 4B is a side view thereof.

Each one of the pair of sharpening assemblies 10 that are detachably installed in the grinding chamber 3 of the main frame casing 1 as described above (they can thus be called grinder cassettes in view of the removability) comprises as shown in FIGS. 4A and 4B a grinder frame 10A formed by a rectangular base plate 12, a pair of vertical shaft supports 14 vertically formed along the two shorter side edges of the rectangular base plate 12 so as to face each other, and a pair of side walls 16 formed along two longer side edges of the rectangular base plate 12 to face each other (The side walls 16 are lower than the vertical shaft supports 14 so as to allow a blade, an abrasive wheel and a rotary shaft to be moved down as described below). Thus, the grinder frame 10A in this example is an empty substantially rectangular block shape.

In each one of the pair of (or two) vertical shaft supports 14 facing each other, a supporting window 14A is opened, and below this supporting window 14A, a vertical channel 14B is provided. In this vertical channel 14B, a vertical coil spring 20, which is greater (longer) than the depth of the vertical channel 14B, is installed so as to stand vertically within the vertical channel 14B. Thus, an upper end portion of the vertical coil spring 20 is outside of the vertical channel 14B to project out therefrom and is located inside the supporting window 14A. A supporting piece 20A is attached to the top end of the vertical coil spring 20 so that the supporting piece 20A is in the supporting window 14A.

The grinder frame 10A thus having a pair of vertical coil springs 20 further includes a rotary shaft 22. This rotary shaft 22 is provided in the grinder frame 10A horizontally with its both ends inside the supporting windows 14A of the vertical shaft supports 14 and on the shaft holder 20A of the coil springs 20. To the top surface of each one of the vertical shaft supports 14 of the grinder frame 10A is attached a holding piece 14C so as to cover the upper opening of each of the supporting windows 14A and prevent the rotary shaft 22 from being removed upwardly from the supporting windows 14A (or from the vertical shaft supports 14 of the sharpening assembly 10). The diameter of the rotary shaft 22 is (slightly) smaller than the width W' of the supporting window 14A, and the height H' of the supporting window 14A is greater than the width W' of the supporting window 14A for substantially the same amount (length) as the upper end portion of the vertical coil spring 20 projecting out of the vertical channel 14B into the supporting window 14A. As a result, the rotary shaft 22 being supported by vertical coil springs 20 in the supporting windows 14A is rotatable within the supporting windows 14A and is movable within the supporting windows 14A vertically (or up and down) and is movable in its axial direction (left and right in FIG. 4A) but is restricted from moving in the direction of the width W' of the supporting window 14A.

The rotary shaft 22 is provided thereon with an abrasive wheel (abrasive element) 30, a pair of lateral coil springs 40 (40A and 40B) on either side of the abrasive wheel 30, and a pair of washers 50 each on the far end side of each coil spring 40 from the abrasive wheel 30.

The abrasive wheel 30 is fixedly provided at substantially the center of the rotary shaft 22 in the axial direction. The abrasive wheel 30 is a cylindrical abrasive element having a V-groove 32 in the circumferential surface, so that it has such a shape that a pair of truncated cone-shaped elements are connected to each other at the smaller diameter end surfaces so as to form the V-groove 32 in between or that a pair of oppositely beveled abrasive disks are connected to each other at the smaller diameter end surfaces.

On either side of the abrasive wheel 30, the lateral coil spring 40 is provided so that one end thereof is in touch with the abrasive wheel 30 and another end thereof is in touch with the washer 50 and so that each coil spring 40 is compressed by and between the abrasive wheel 30 and the washer 50 or the vertical shaft supports 14. In other words, the abrasive wheel 30 is urged by the coil springs 40 towards the axial center of the rotary shaft 22 as shown by A-1 and A-2 arrows in FIG. 4A so as to be at the center or at a mid-point between the two vertical shaft supports 14 of the grinder frame 10A. The two lateral coil springs 40 (40A, 40B) have the inner diameter slightly larger than the diameter of the rotary shaft 22 so that they are loosely disposed around the rotary shaft 22 on both sides of the abrasive wheel 30. Also, these coil springs 40 (40A, 40B) are substantially the same in length and have substantially the same spring force with each other. Thus, in FIG. 4A, the coil spring 40A urges the abrasive wheel 30 into the right direction shown by arrow A-1, and the coil spring 40B which is on another side of the abrasive wheel 30 urges the abrasive wheel 30 into the left direction shown by allow A-2 or in the opposite direction from the direction the coil spring 40A urges the abrasive wheel 30.

The washers 50 of a thin plate having an inner diameter slightly larger than the diameter of the rotary shaft 22 are disposed on the rotary shaft 22, and the outer diameter of the washers 50 is greater than the size of the supporting windows 14A, particularly greater than the width W' (see FIG. 4B) of the supporting window 14A, of the vertical shaft supports 14 of the grinder frame 10A, so that the surface of each of the washers 50 that faces the vertical shaft support 14 is slidably in contact with the inner surface of the vertical shaft support 14.

In the above-described sharpener, each one of the pair of sharpening assemblies 10 includes a box type grinder frame 10A that is comprised of the facing vertical shaft support 14 and the side walls 16. However, since the rotary shaft 22 is supported only by the facing vertical shaft support 14, the side walls 16 can be eliminated.

Figure 11A:
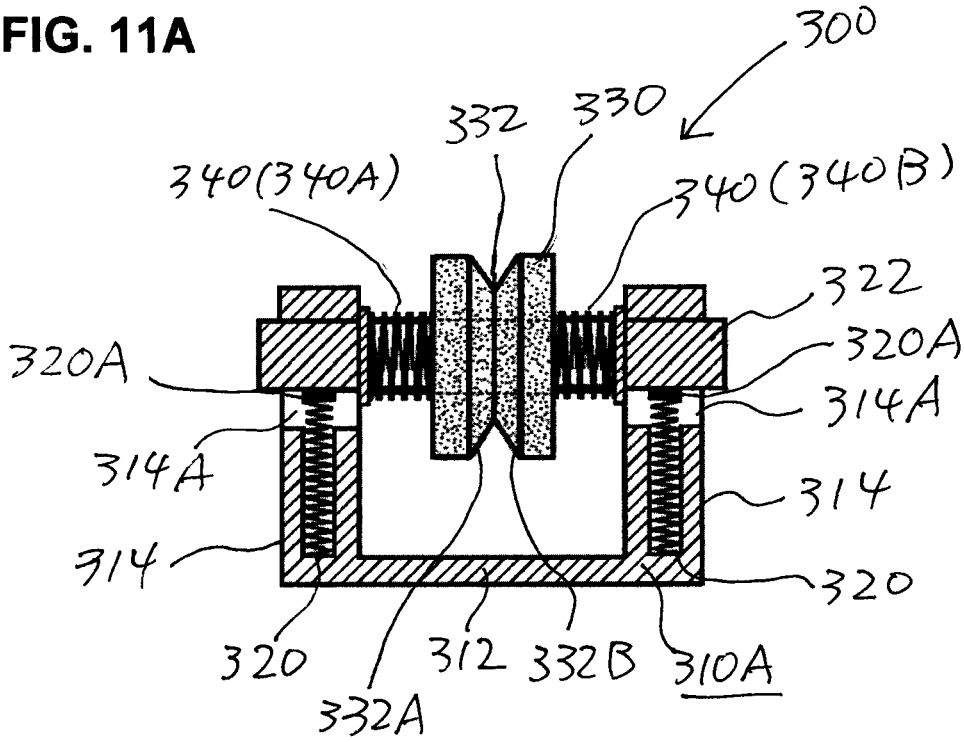
FIG. 11A is a vertically cross-sectional view of still another type of sharpening assembly according to the present invention.
Figure 11B:
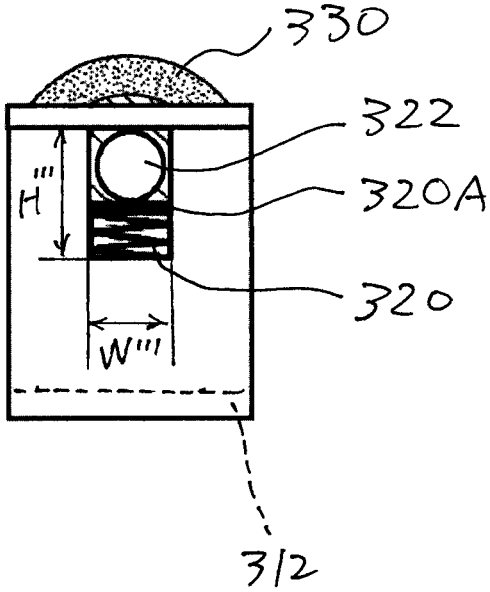
FIG. 11B is a side view thereof.

In other words, as seen from FIGS. 11A and 11B, a sharpening assembly 300 that is detachably installed in the grinding chamber 3 of the main frame casing 1 (it can thus be called a grinder cassette in view of the removability) is comprised of a grinder frame 310A formed by a rectangular base plate 312 and a pair of vertical shaft supports 314 vertically formed along the two shorter side edges of the rectangular base plate 312 so as to face each other (and no side walls corresponding to the side walls 16 provided). These vertical shaft supports 314 can be narrower than the vertical shaft support 14 of the above described sharpening assembly 10 (see FIGS. 4B and 11B). The other structures of the sharpening assembly 300 are substantially the same as those of the sharpening assembly 10, including the vertical coil springs 320 provided in the vertical shaft supports 314 (same as the coil springs 20 provided in the vertical shaft supports 14), the rotary shaft 322 (22) set on the supporting piece 320A of the vertical coil springs 320 (20) with both ends thereof in the supporting window 314A (14A) (having the width W''' and height H''' (W' and H') of the vertical shaft supports 314 (vertical shaft support 14), the abrasive wheel 330 (30) fixedly provided on the rotary shaft 322 (22), and the horizontal coil springs 340 (40) provided on both sides of the abrasive wheel 332.

Figure 5:
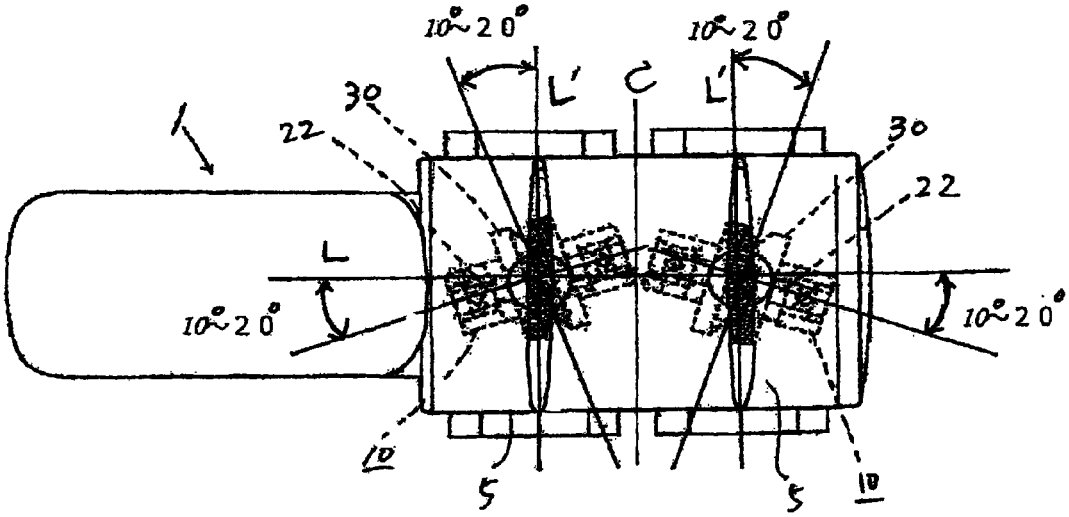
FIG. 5 illustrates an arrangement of sharpening assemblies installed in the grinding chamber of the blade sharpener of the present invention.

The above described sharpening assembly 10, 300 comprising, among other elements, the grinder frame 10A, 310A, the rotary shaft 22, 322, the lateral coil springs 40, 340 and the vertical coil springs 20, 320, are installed in the grinding chamber 3 so that they are respectively directly below the blade guide slits 5 formed in the cover casing 4 of the main frame casing 1 and so that the rotary shafts 22, 322 and thus the grinding wheels 30, 330 of these two sharpening assemblies 10, 300 are at bias or diagonal with respect to the length direction L' (see FIG. 5) of the blade guide slits 5 of the main frame casing 1. More specifically, as seen from FIG. 2 and FIG. 5, the pair of holding means 6 are provided on the bottom 3*a* of the grinding chamber 3 so as to have a bias or diagonal angle of 10-25 degrees with respect to the length direction L of the grinding chamber 3 (see FIG. 2), and thus the two sharpening assemblies 10, 300 that are respectively held by these holding means 6 each comprising four projections 6*a* are provided so that the center of the abrasive wheel 30, 330 or the V-groove 32, 332 thereof is at a bias or diagonal angle of about 10 to 20 degrees with respect to the length direction L' of the blade guide slits 5, and the rotary shafts 22, 322 take a symmetric positional relationship with each other about the center line C of the grinding chamber 3 which is at right angles to the direction of length L of the grinding chamber 3.

The arrangement of the sharpening assemblies 10, 300 can take another manner in which the rotary shafts 22, 322 are set to be parallel to each other, and in which a only one (or single) sharpening assembly 10, 300 is installed in a grinding chamber 3. Furthermore, as seen from FIG. 10, the main frame casing 1 can be of a single type, wherein the cover casing 4 has only one blade guide slit 5 so that a single sharpening assembly 10, 300 is detachably installed in its grinding chamber 3.

Figure 14:
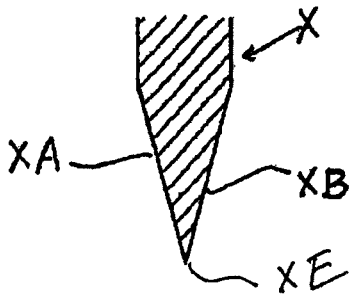
FIG. 14 RELATED ART
FIG. 14 illustrates the cross-section of a known double-edged blade.

In the above described structure, the abrasive wheel 30, 330 has a cylindrical shape in which the V-groove 32, 332 is in the axial center and in such a shape that a pair of two truncated cones (or beveled disks) of the same diameter are connected to each other at the smaller diameter end surfaces, thus having a symmetric grinding surfaces 32A and 32B, 332A and 332 along the V-groove 32, 332 and thus being called in the description a "symmetric abrasive wheel." This symmetric abrasive wheel is suitable to sharpen a double-edged blade X as shown in FIG. 14 that has the same blade surface XA and XB on both sides.

Figure 6:
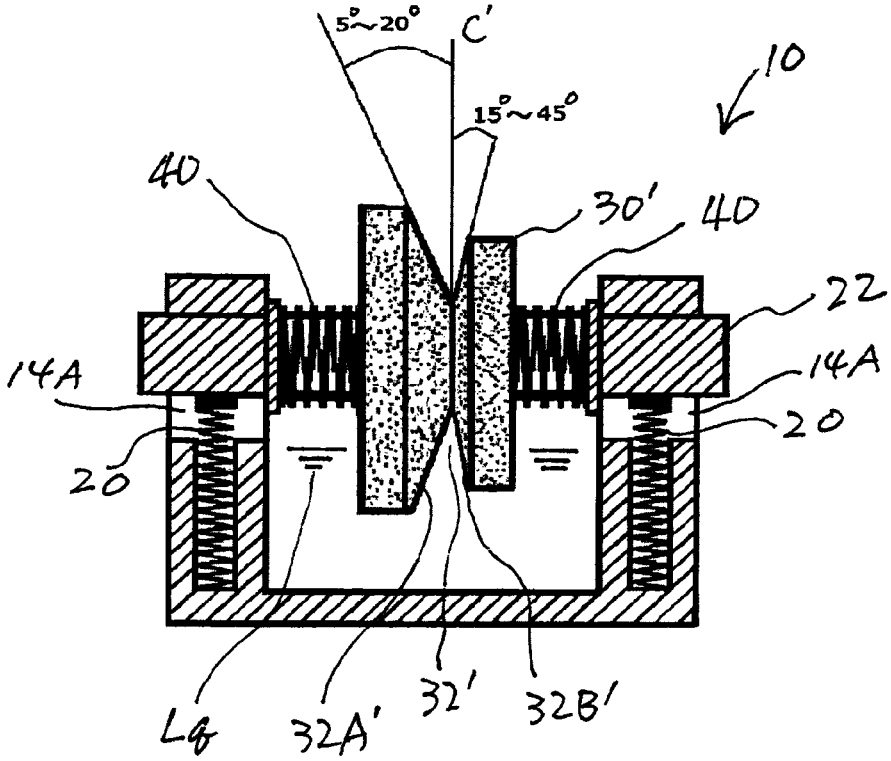
FIG. 6 is a vertically cross-sectional view of the first type of sharpening assembly according to the present invention with an asymmetric abrasive wheel is employed.
Figure 15:
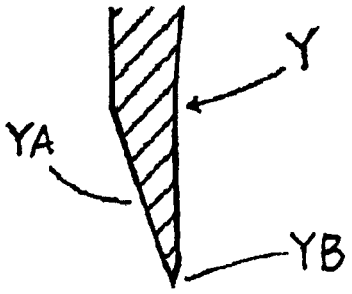
FIG. 15 RELATED ART
FIG. 15 illustrates the cross-section of a known single-edged blade.

The abrasive wheel in the present invention can be of another type as shown in FIG. 6. In this abrasive wheel 30', the diameters of the two truncated cone elements (or beveled disks) are different from each other, so that the V-groove 32' is asymmetric with one grinding surface 32A' has more acute angle than the other grinding surface 32B', thus being called in the description an "asymmetric abrasive wheel." In the shown asymmetric abrasive wheel 30', the grinding surface 32A' on the left side is about 5 to 20 degrees with respect to the imaginary vertical line C' and the grinding surface 32B' on the right side is about 15 to 45 degrees with respect to the vertical center line C'. This asymmetric abrasive wheel 30' is suitable to sharpen a single-edged blade Y as shown in FIG. 15 that has on one side of the blade a single blade surface YA (the blade Y can be formed with a minute blade surface YB on another side). The above-described abrasive wheel 330 on the rotary shaft 322 shown in FIG. 11A can be indeed replaced by the abrasive wheel 30' of FIG. 6.

In use of the above-described blade sharpener, a pair of sharpening assemblies 10 (more specifically, two sharpening assemblies both having symmetric abrasive wheels, or both having asymmetric abrasive wheels or one having a symmetric abrasive wheel and the other having an asymmetric wheel) are set in the grinding chamber 3 by being held by the holding means 6. The sharpening assembly or assemblies 10 can be provided with a liquid Lq, therein such as water or oil, and the grinding chamber 3 is covered by the cover casing 4. In use of the sharpening assembly 300 installed in the grinding chamber 3, the liquid is provided inside the grinding chamber 3.

Figure 7:
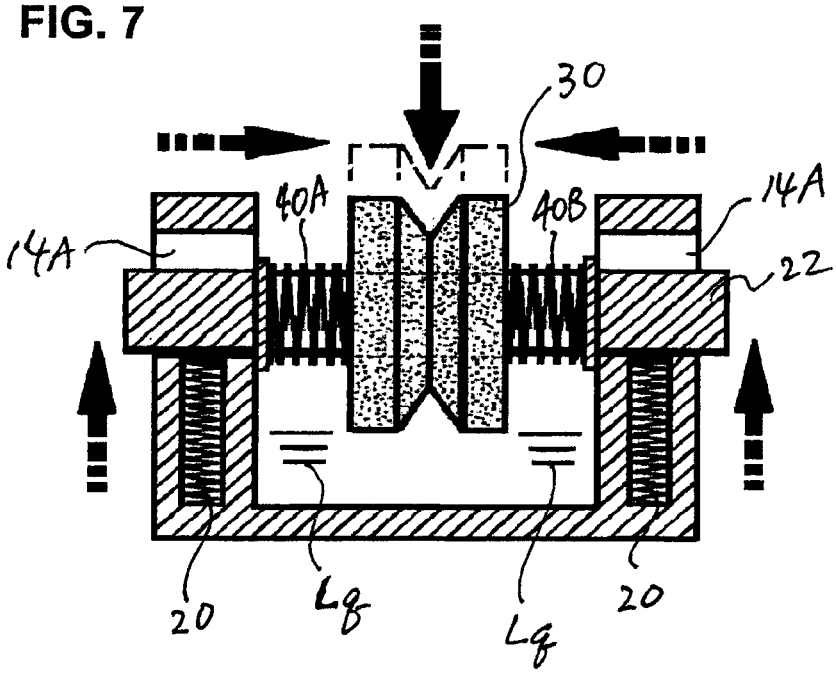
FIG. 7 illustrates the sharpening assembly of FIG. 4A with the abrasive wheel depressed down during grinding.

With the cover casing 4 thus set and the grip 2 gripped by one hand, the blade (such as the blade X) of a knife held by another hand at the handle is inserted into the guide slit 5 and pressed down against the abrasive wheel 30, 330 so that the cutting edge of the blade X comes into contact with the V-groove 32, 332 of the abrasive wheel 30, 330 and then moved back and forth inside the blade guide slit 5 along its length direction or in the direction of the width W of the grinding chamber 3. As a result, the blade surfaces XA and XB contact the grinding surfaces 32A and 32B, 332A and 332B while being pressed against thereto, and the blade X is thus sharpened. Since the blade X is pressed against the abrasive wheel 30, 330, the rotary shaft 22, 322 is pressed and moved down within the supporting windows 14A 314A as shown in FIG. 7, and the vertical coil springs 20, 320 press back (upward) the rotary shaft 22, 322 as indicated by upward arrows (when pressing down force is weakened). The blade X thus receives pressing forces from above (by the user) and from below (by the vertical coil springs); and as a result, it is pressed substantially uniformly against the grinding surfaces 32A and 32B, 332A and 332B and thus sharpened evenly and efficiently.

In addition to these vertical pressing forces, the blade X receives lateral or horizontal pressing forces from one side (for instance, from the left side by the lateral coil spring 40A, 340A) and from another side (for instance, from the right side by the lateral coil spring 40B, 340B) when the blade X is moved back and forth in a reciprocating manner in the blade guide slit 5. More specifically, since the rotary shaft 22, 322 is set to have a biased or diagonal angle relationship (of 10-20 degrees) with respect to the blade guide slit 5, when the blade X is moved in one direction, one lateral coil spring (for instance the spring 40A, 340A) is compressed and the other lateral coil spring (for instance spring 40B, 340B) expands; and when the blade X is moved in another or opposite direction, then the coil spring compressed (spring 40A, 340A) expands and the spring expanded (spring 40B, 340B) is compressed. When grinding is thus performed and continued, these lateral or horizontal pressing forces that are opposite from each other in direction and are equal to each other in strength are repeatedly applied to the blade X. As a result, in addition to the vertical pressing forces given by the user and vertical coil springs 20, 320, the blade X repeatedly receives equal amount of lateral or side pressing forces from the two lateral springs 40, 340 (40A, 340A, 40B. 340B) and is pressed sideways substantially uniformly and repeatedly against the grinding surfaces 32A, 332A and 32B, 332B of the abrasive wheel 30, 330. The blade X is, accordingly, sharpened further evenly, efficiently and smoothly.

Also, during the back and forth movements of blade X with a pressing force applied thereto from above, the rotating abrasive wheel 30, 330 can come in contact with the liquid Lq in the sharpening assembly 10 or in the grinding chamber 3. This liquid Lq absorbs the heat generated during the grinding and prevents the blade X from dulling that would be caused by heat, and it washes away the grinding debris or residue and thus allows the grinding surfaces 32A, 332A and 32B, 332B clean and in good grinding conditions without getting clogged.

When the blade X is pressed against the abrasive wheel 30, 330 as described above, the pressing back forces by the vertical coil springs 22, 322 make the force of the abrasive wheel 30, 330 applying to the blade X substantially uniform. As a result, with an addition of the lateral or horizontal pressing forces by the lateral coil springs 40, 340, grinding of even a serrated edge knife such as bread slicing knives and fine ceramic blades and the like can be performed efficiently.

A single-edged blade Y shown in FIG. 15 can be ground in the substantially the same manner as in the blade X. The blade surface YA is brought into contact with the grinding surface 32A, 332A, and the blade Y is pressed down and moved back and forth within the guide slit 5, and the blade Y is thus sharpened while receiving the lateral forces from the lateral coil springs and also receiving the longitudinal forces from the vertical coil springs.

As seen from the above, according to the present invention, a blade to be sharpened (including both double-edged blade and single-edged blade) receives pressing forces of not only in the vertical direction (or in the up and down directions) but also in the horizontal direction (or in the right and left directions). Accordingly, the blade is ground and sharpened smoothly and evenly, producing a sharp cutting edge.

In the above describe structure and operation, the sharpening assembly 10, 300 is provided with a pair of vertical coil springs and a pair of lateral coil springs. However, the object of the present invention can be accomplished by a structure that includes only a pair of lateral springs.

Figure 8A:
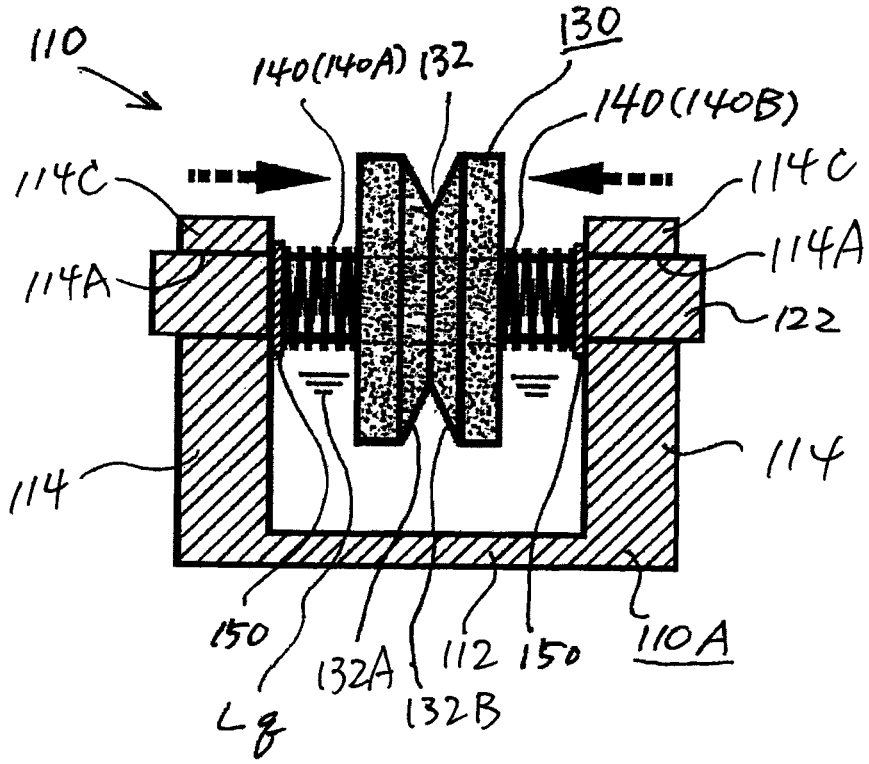
FIG. 8A is a vertically cross-sectional view of another type of sharpening assembly according to the present invention with a symmetric abrasive wheel employed.
Figure 8B:
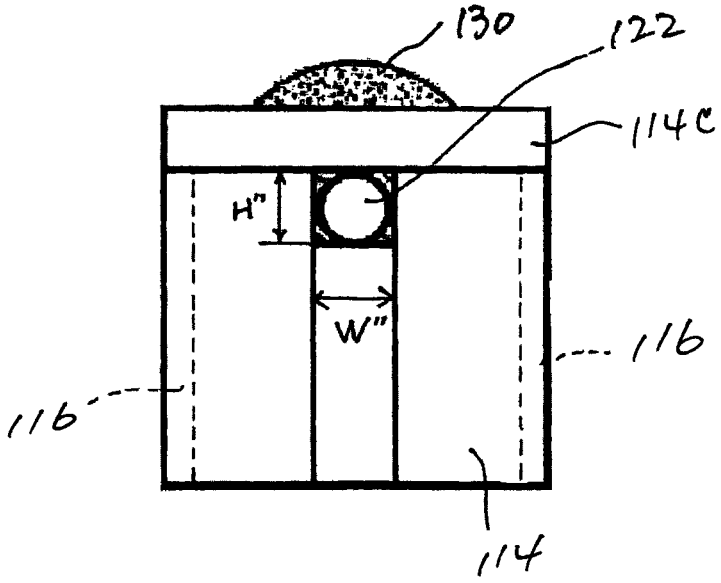
FIG. 8B is a side view thereof.

In this aspect of the present invention, as seen from FIGS. 8A and 8B, each one of pair of sharpening assemblies 110 that are to be detachably installed in the grinding chamber 3 of the main frame casing 1 (they can thus be called grinder cassettes as well in view of the removability) comprises a grinder frame 110A that is formed by a rectangular base plate 112, a pair of vertical shaft supports 114 vertically formed along the two end shorter side edges of the rectangular base plate 112 so as to face each other, and a pair of side walls 116 formed along two longer side edges of the rectangular base plate 112 to face each other. In each one of the pair (two) of vertical shaft supports 114 facing each other, a supporting window 114A is opened.

In addition, the sharpening assembly 110 further includes a rotary shaft 122. This rotary shaft 122 is provided within the sharpening assembly 110 horizontally with its both ends inside the supporting windows 114A of the vertical shaft supports 114. To the top surface of each one of the vertical shaft supports 114 is attached a holding piece 114C so as to cover the upper opening of each of the supporting windows 114A and prevent the rotary shaft 122 from being removed upwardly from the supporting windows 114A (or from the vertical shaft supports 114 of the sharpening assembly 110). The diameter of the rotary shaft 122 is (slightly) smaller than the width W" and height H" of the supporting window 114A. As a result, the rotating shaft 122 is rotatable within the supporting windows 114A.

The rotary shaft 122 is provided thereon with an abrasive wheel (abrasive element) 130, a pair of lateral coil springs 140 (140A and 140B) each on either side of the abrasive wheel 130, and a pair of washer 150 each on the far end side of each coil spring 140 from the abrasive wheel 130. This structure that includes the rotary shaft 122 with the abrasive wheel 130, the lateral coil springs 140 and the washers 150 thereon and the functions of the these parts are the same as those of the structure of the rotary shaft 22 having thereon the abrasive wheel 30, the lateral coil springs 40 and the washers 50 shown in FIGS. 4A and 4B.

Figure 9:
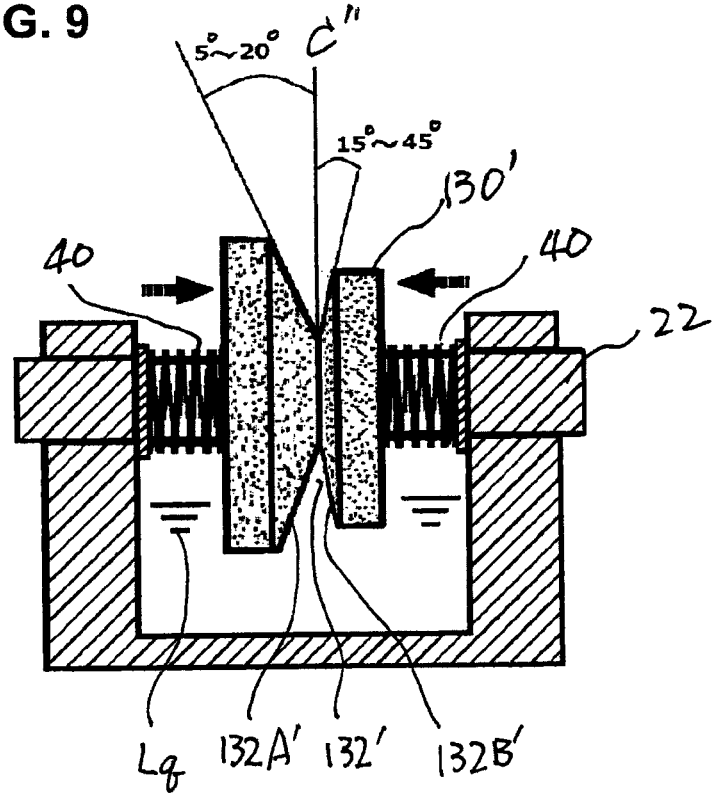
FIG. 9 is a vertically cross-sectional view of the other type of sharpening assembly according to the present invention with an asymmetric abrasive wheel is employed.

In addition, an asymmetric abrasive wheel 130' as shown in FIG. 9 can be employed instead of the abrasive wheel 130 shown in FIG. 8A. In this abrasive wheel 130', the diameters of the two truncated cone elements (or beveled disks) are different from each other, so that the V-groove 132' is asymmetric with one grinding surface 132A' has more acute angle than the other grinding surface 132B'. In the shown asymmetric abrasive wheel 130', the grinding surface 132A' on the left side is about 5 to 20 degrees with respect to an imaginary vertical line C" and the grinding surface 132B' on the right side is about 15 to 45 degrees with respect to the imaginary vertical line C". This asymmetric abrasive wheel 130' is also suitable to sharpen a single-edged blade Y as shown in FIG. 12

In the above-described sharpener, the sharpening assembly includes a box type grinder frame that is comprised of the facing vertical shaft supports 114 and side walls 116. However, since the rotary shaft 122 is supported only by the facing shaft supports 114, the side walls 116 can be eliminated.

Figure 12A:
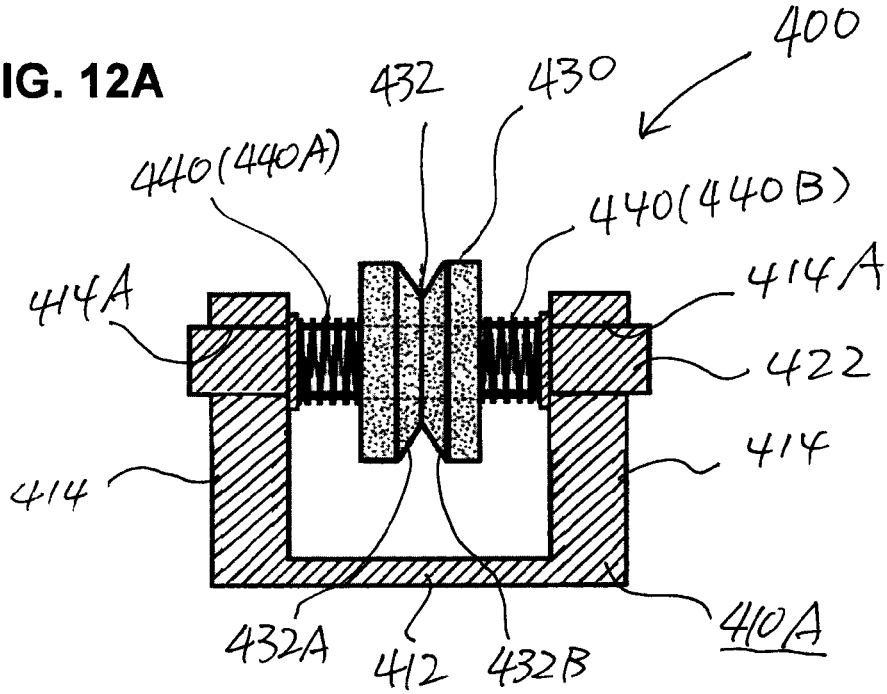
FIG. 12A is a vertically cross-sectional view of still another type of sharpening assembly according to the present invention.
Figure 12B:
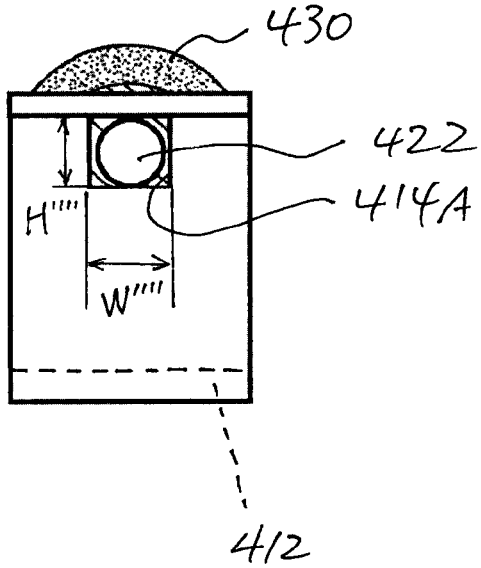
FIG. 12B is a side view thereof.

In other words, as seen from FIGS. 12A and 12B, each one of the pair of sharpening assemblies 400 that are detachably installed in the grinding chamber 3 of the main frame casing 1 (they can thus be called grinder cassettes as well in view of the removability) is comprised of a grinder frame 410A formed by a rectangular base plate 412 and a pair of vertical shaft supports 414 vertically formed along the two shorter side edges of the rectangular base plate 412 so as to face each other (and no side walls corresponding to the side walls 116 provided). These vertical shaft supports 414 can be narrower than the shaft supports 114 of the above described sharpening assembly 110. The other structures of the sharpening assembly 400 are substantially the same as those of the sharpening assembly 110, including the rotary shaft 422 (122) with both ends thereof in the supporting windows 414A (114A) (having the width W"" and height H"" (W" and H") of the vertical shaft supports 414 (114) and the abrasive wheel 430 (130) fixedly provided on the rotary shaft 422 with horizontal coil springs 440 (140) on both sides of the abrasive wheel 430 (130).

Figure 10:
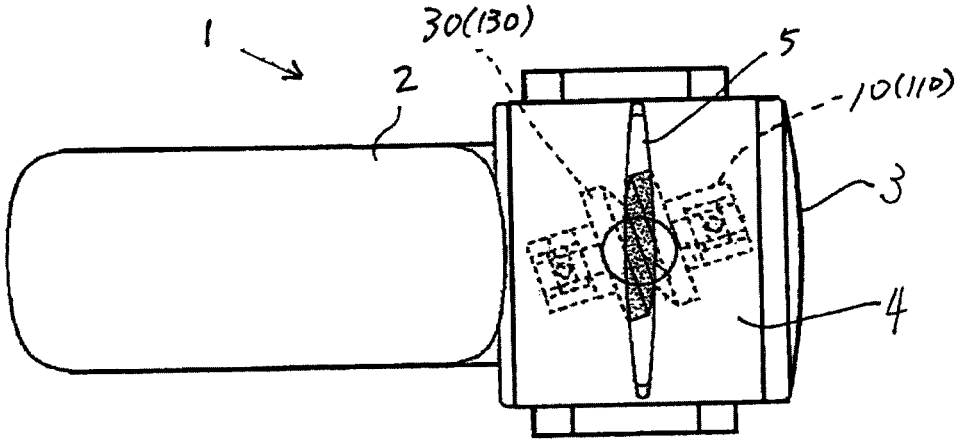
FIG. 10 is a top view of a main frame casing of a blade sharpener in which the cover casing is formed with one single blade slit so that a single sharpening assembly is installed in the grinding chamber.

The above described sharpening assembly 110, 400 including the horizontal rotary shaft 122, 422 and the lateral coil springs 140, 440 are installed in the grinding chamber 3 shown in FIG. 1 or FIG. 10 in the same manner as that of the sharpening assembly 10, 300.

In use, the sharpening assembly 110, 400 (in other words, two sharpening assemblies both having symmetric abrasive wheel, or both having asymmetric abrasive wheels or one having a symmetric abrasive wheel and the other having an asymmetric wheel) is set in the grinding chamber 3 by being held by the holding means 5. The sharpening assembly 110 can be filled with a liquid Lq, such as water or oil, and the grinding chamber 3 is covered by the cover casing 4. In use of the sharpening assembly 400, the liquid is provided inside the grinding chamber 3.

With the cover casing 4 thus set and the grip 2 gripped by one hand, the blade X of a knife held by another hand at the handle is inserted into the guide slit 5 and pressed down against the abrasive wheel 130, 430 so that the cutting edge XE of the blade X comes into contact with V-groove 132, 432 of the abrasive wheel 130, 430 and then moved back and forth inside the blade guide slit 5 along its length direction or in the direction of the width W of the grinding chamber 3. As a result, the blade surfaces XA and XB contact the grinding surfaces 132A and 132B, 432A and 432B while being pressed against thereto, and the blade X is thus sharpened.

More specifically, the blade X receives lateral pressing forces from one side (for instance from the left side by the lateral coil spring 140A, 440A) and from another side (for instance from the right side by the lateral coil spring 140B, 440B) when the blade X is moved back and forth in a reciprocating manner in the blade guide slit 5. In other words, since the rotary shaft 122, 422 is set to have a biased or diagonal angle relationship (of 10-20 degrees) with respect to the blade guide slit 5, when the blade X is moved in one direction, one lateral coil spring (for instance the spring 140A, 440A) is compressed and the other lateral coil spring (for instance spring 140B, 440B) expands, and when the blade X is moved in another or opposite direction, then the coil spring compressed (spring 140A, 440A) expands and the spring expanded (spring 140B, 440B) is compressed. When grinding is performed and continued, these lateral or horizontal pressing forces that are opposite from each other in direction and are equal to each other in strength are repeatedly applied to the blade X. As a result, the blade X repeatedly receives equal amount of lateral or side pressing forces from the two lateral springs 140 (140A, 140B), 440 (440A, 440B) and is pressed sideways substantially uniformly and repeatedly against the grinding surfaces 132A and 132B of the abrasive wheel 130 or the grinding surfaces 432A and 432B of the abrasive wheel 430. The blade X is thus sharpened evenly, efficiently and smoothly. The blade Y as shown in FIG. 15 can be ground in the same manner as above with the sharpening assembly shown in FIG. 9 and FIGS. 12A and 12B.

As seen from the above, according to the above-described structure, since a blade to be sharpened (including both double-edged blade and single-edged blade) receives pressing forces in the horizontal direction (or in the right and left directions), the blade is ground and sharpened smoothly and evenly, producing a sharp cutting edge.

The above-described abrasive wheel 430 on the rotary shaft 422 can be indeed replaced by the abrasive wheel 130' shown in FIG. 9.

Furthermore, a single sharpening assembly 110, 400 can be installed in the grinding chamber 3 of the main frame casing 1 that is of a single type with the cover casing 4 having only one blade guide slit 5.

While the abrasive wheels 30, 130, 330, 430 are formed by the same material entirely, the materials that make the grinding surface 32A, 132A, 332A, 432A can be alumina- or silicon-carbide ceramics, and the like, and the materials that make the grinding surfaces 32B, 132B, 332B, 432B can be different substances including silica clay ceramics, or alumina fine ceramics or alumina new ceramics, forming the surfaces smooth and hard. This different substance grinding surfaces can be applied to the abrasive wheels 30' and 130' as well.

Figure 13:
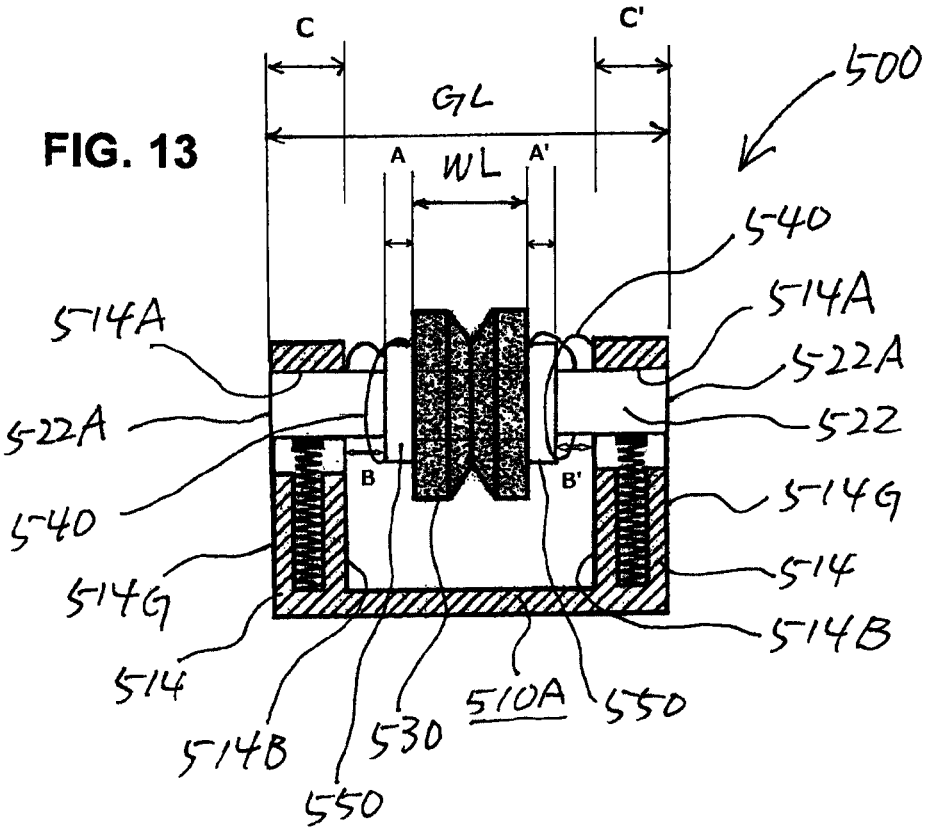
FIG. 13 is a partially and vertically cross-sectional view of still another type of sharpening assembly according to the present invention.

Furthermore, as seen from FIG. 13, the rotary shaft can be provided with a cylindrical stopper element on either side of an abrasive wheel. In this sharpening assembly 500 of FIG. 13, the rotary shaft 522 has substantially the same axial length as the length GL of the sharpening assembly 500 so that the end surfaces 522A of the rotary shaft 522 are flush with the outer surfaces 514G of the vertical shaft supports 514 of the grinder frame 510A. This rotary shaft 522 is provided with an abrasive wheel 530 and further with a pair of cylindrical stopper elements 550 each on either side of the abrasive wheel 530 and is preferably made of the same material as that of the rotary shaft 522. Each one of the pair of the horizontal coil springs 540 is provided on either side of the abrasive wheel 530. The coil springs 540 may have a diameter larger than the diameter of the stopper elements 550 so that they can partly cover the stopper elements 550.

Cylindrical stopper elements 550 are greater in diameter than the width of the supporting window 514A (see, for instance, FIG. 11B for the width (W''') of the supporting window), and they are in contact with the abrasive wheel 530 at its one end surface (inside end surface) and have a certain length (or a thickness) A, A', so that each end (for instance left end in FIG. 13) of the rotary shaft 522 is prevented from coming off the (left side) vertical shaft support 514 (or off the left side supporting window 514A) even when the rotary shaft 522 is moved horizontally to one side (for instance, rightward in FIG. 13) until one of the cylindrical stopper elements 550 (for instance, right side stopper element that has the length/thickness A') comes into contact with the inner surface 514B of one of the vertical shaft supports 514 (for instance, right side shaft support). In other words, when the vertical shaft supports 514 of the grinder frame 510A has a thickness C, C', and the distance between the inner surface 514B of the shaft supports 514 and the stopper element 550 is B, B', then the sharpening assembly and the rotary shaft that has thereon the abrasive wheel and stopper elements satisfy the formula $A+B=A'+B'<C, C'$, so that the rotary shaft is prevented from coming off the grinder frame when it is moved horizontally or sideways during the sharpening regardless of the thickness WL of the abrasive wheel 530.

Also, though the coil springs are described as a horizontally urging means to keep the abrasive wheel to the mid point between the facing shaft supports of the sharpening assembly, any other urging means can be used instead in the present invention such as a so-called washer-less-spring that is made of plastic. In addition, a permanent magnet and/or rubber sheets can be affixed to the underside of the main frame casing so as to help prevent the sharpener from slipping during the use or grinding.

The invention claimed is:

1. A blade sharpener comprising:

a main frame casing having a grinding chamber; and a sharpening assembly detachably installed in the grinding chamber and comprised of:

a grinder frame formed by a support base and a pair of vertical shaft supports facing each other at both ends of the support base;

a vertically urging means provided in each of the vertical shaft supports;

a rotary shaft supported at both ends thereof by the vertically urging means and movable in an axial direction thereof;

an abrasive element provided on the rotary shaft at substantially an axial center thereof, and horizontally urging means provided on both sides of the abrasive element.

2. The blade sharpener according to claim 1, wherein said abrasive element is in substantially a cylindrical shape with a V-groove at an axial center thereof.

3. The blade sharpener according to claim 2, wherein said abrasive element is formed by a pair of beveled disks of different diameters so that smaller diameter sides of said pair of abrasive wheels of different diameters are connected to each other to form the V-groove.

4. The blade sharpener according to claim 1, wherein said grinding chamber is covered by a cover casing formed therein with a blade guide slit and said sharpening assembly is disposed under said blade guide slit so that the rotary shaft of the sharpening assembly is set to be at a biased angle with respect to a length direction of the blade guide slit.

5. The blade sharpener according to claim 1, wherein said shaft supports are respectively provided with supporting windows with both ends of said rotary shaft therein and set on the vertically urging means.

6. The blade sharpener according to claim 1, wherein each of said horizontally urging means is a coil spring.

7. The blade sharpener according to claim 1, wherein said rotary shaft is further provided with cylindrical stopper elements provided on both sides of the abrasive element so as to prevent one end of said rotary shaft from coming off the vertical shaft support.

8. The blade sharpener according to claim 1, wherein said main frame casing further has a grip.

9. A blade sharpener comprising:

a main frame casing having a grinding chamber; and a sharpening assembly detachably installed in the grinding chamber and comprised of:

a grinder frame formed by a support base and a pair of vertical shaft supports facing each other at both end of the support base;

a supporting widow provided in each one of the vertical shaft supports;

a rotary shaft with either end thereof inside the supporting window of each of the vertical shaft supports so as to be movable in an axial direction thereof;

an abrasive element provided on the rotary shaft at substantially an axial center thereof, and horizontally urging means provided on both sides of the abrasive element.

10. The blade sharpener according to claim 9, wherein each one of said shaft supports is provided therein with a vertically urging means so that either end of said rotary shaft is provided on the vertically urging means within the supporting window.

11. The blade sharpener according to claim 9, wherein said grinding chamber is covered by a cover casing formed therein with a blade guide slit and said sharpening assembly is disposed under said blade guide slit so that the rotary shaft of the sharpening assembly is set to be at a biased angle with respect to a length direction of the blade guide slit.

12. The blade sharpener according to claim 9, wherein said rotary shaft is further provided with cylindrical stopper elements provided on both sides of the abrasive element so as to prevent one end of said rotary shaft from coming off the vertical shaft supports.

13. A blade sharpener comprising:

a main frame casing having a grinding chamber; and a sharpening assembly detachably installed in the grinding chamber and comprised of:

a grinder frame of a rectangular block shape having a rectangular base plate, a pair of vertical shaft supports formed along two shorter side edges of the rectangular base plate so as to face each other, and a pair of side walls formed along two longer side edges of the rectangular base plate to face each other;

a supporting widow provided in each one of the vertical shaft supports;

a rotary shaft rotatably provided with both ends thereof respectively within the supporting windows of the vertical shaft supports so as to be movable in an axial direction thereof;

an abrasive element provided on the rotary shaft at substantially an axial center thereof, and horizontally urging means provided on both sides of the abrasive element.

14. The blade sharpener according to claim 13, wherein each one of said shaft supports is provided therein with a vertically urging means so that either end of said rotary shaft is provided on the vertically urging means within the supporting window.

15. The blade sharpener according to claim 13, wherein said grinding chamber is covered by a cover casing formed therein with a blade guide slit and said sharpening assembly is disposed under said blade guide slit so that the rotary shaft of the sharpening assembly is set to be at a biased angle with respect to a length direction of the blade guide slit.

* * * * *